US006386358B1

(12) United States Patent
North et al.

(10) Patent No.: US 6,386,358 B1
(45) Date of Patent: May 14, 2002

(54) TABLET PACKAGE

(76) Inventors: Richard David North, Ainsdale, Tettenhall, Wolverhampton WV6 8SE; Peter Thomas Bowdler, Flat 2, 4 Queens Park West Drive, Queens Park, Bournemouth BH8 9BX, both of (GB)

( * ) Notice: Subject to any disclaimer, the term of this patent is extended or adjusted under 35 U.S.C. 154(b) by 0 days.

(21) Appl. No.: 09/602,851

(22) Filed: Jun. 26, 2000

(51) Int. Cl.[7] ..... B65D 77/00
(52) U.S. Cl. ..... 206/217; 206/531; 215/6
(58) Field of Search ..... 206/217, 218–221, 206/528, 568, 530, 531, 534, 538, 539; 215/228, DIG. 7, DIG. 8, 6

(56) References Cited

U.S. PATENT DOCUMENTS

| | | | | | |
|---|---|---|---|---|---|
| 4,348,421 | A | * | 9/1982 | Sakakibara et al. | 206/217 |
| 4,703,849 | A | * | 11/1987 | Vezirian et al. | 206/217 |
| 4,776,972 | A | * | 10/1988 | Barrett | 206/219 |
| 4,793,475 | A | * | 12/1988 | Itzel | 206/221 |
| 4,923,702 | A | * | 5/1990 | Powell et al. | 206/217 |
| 5,238,140 | A | * | 8/1993 | Maze | 206/217 |
| 5,370,222 | A | * | 12/1994 | Steigerwald et al. | 206/219 |
| 5,746,312 | A | * | 5/1998 | Johnson | 206/217 |

FOREIGN PATENT DOCUMENTS

| | | |
|---|---|---|
| DE | 23 55 194 | 5/1975 |
| DE | 298 00 794 U1 | 3/1998 |
| FR | 2290366 | 6/1976 |
| GB | 1211168 | 11/1970 |
| WO | WO97/09242 | 3/1997 |
| WO | WO99/44901 | 9/1999 |

* cited by examiner

*Primary Examiner*—Luan K. Bui
(74) *Attorney, Agent, or Firm*—Yongzhi Yang; Steven J. Hultquist; Marianne Fuierer

(57) ABSTRACT

The present invention relates to a tablet package that contains a predetermined number of tablet(s) and a predetermined quantity of liquid. The liquid in such tablet package is stored within a reservoir and is seperated from the tablet(s). The tablet(s) in such package is stored within a sealed compartment located in a closure member (e.g. a screw cap), which functions to close the reservoir and retains the liquid within the reservoir prior to use of the tablet package. The sealed compartment for storing the tablet(s) preferably has a breakable sheet through which the tablet(s) can be ejected. More preferably, the container has separating means (e.g. a grill member) located between the breakable sheet and the reservoir to prevent the tablet(s) from entering the liquid.

7 Claims, 9 Drawing Sheets

TABLET PACKAGE

FIELD OF THE INVENTION

This invention relates to a tablet package.

It will be clear from the following description that the invention could be utilised by solids in other than tablet form, and the word "tablet" should therefore be construed to include small amounts of solid material in other suitable forms, such as powder or granules. However, it is expected that the invention will find its greatest utility for medicants and the like which are in conventional "tablet" form, and the following description will therefore relate predominantly to such utility.

Background to the Invention

Many medicants such as headache relieving drugs are sold in solid form, usually in the form of a tablet. Some types of of tablet are soluble and are intended to be dissolved in water before consumption; others are substantially insoluble in water and are intended to be consumed in solid form. However, even with a substantially insoluble tablet it is recommended that the tablet be placed in the mouth and then a quantity of water be drunk to carry the tablets into the stomach.

Thus, it is known that certain tablet formulations are corrosive outside the stomach, so that if the tablet should become lodged in the throat it can cause damage to the user. There is also the possibility of the individual choking on a tablet which is attempted to be swallowed without water.

Description of the Prior Art

A tablet should ideally be maintained dry and clean before use, and a known package incorporates individual sealing means for the tablet in the form of a "blister pack" comprising a wrapping of aluminium foil and/or plastic or the like. To open the wrapping and expose the tablet, it is known to press the tablet towards the aluminium foil until the foil breaks.

Medicants in tablet form are often sold in boxes containing a certain number of tablets, individually sealed in a wrapping such as that described above. Users of such medicants will often maintain a store of tablets at their home or other suitable location, for use as and when required.

Often, users will take tablets without water notwithstanding the potential dangers of such practice. The required quantity of clean water may not be readily available, and the user may not wish to take the time or trouble to obtain it.

Packages are also known for the separate storage of a liquid and a solid material. In particular, a food storage container known as a "twin pot" is available in which a liquid such as yoghurt can be stored separately from a solid such as cereal grains, the solid and liquid being mixed immediately prior to, or at the time of, consumption. A similar "twin pot" arrangement is known in which cereal grains are stored in one part and milk in another part.

DISCLOSURE OF THE INVENTION

It is an object of the invention to provide a package for tablets, and in particular tablets of medicant, which avoid or reduce the above stated problems.

According to the invention, there is provided a tablet package in which can be located a predetermined quantity of to tablets, characterised in that the package also contains a predetermined quantity of liquid.

The predetermined quantity of tablets may be one or more, and usually will be determined to be a sufficient number, and/or the tablet(s) can be of sufficient effective strength, for a single dose for an adult for example. The package is therefore primarily intended to be purchased for the immediate relief of a headache or other ailment, rather than for the storage for later use. As such, the package could be sold at petrol stations or other convenient sites and so serve individuals who have need of medication but who are away from their store of medicant. Since the liquid (typically water) is also contained within the package, the user does not need to locate a suitable source for this, and the likelihood of the user taking the tablet(s) without liquid is reduced or avoided.

Preferably, the liquid is stored within a reservoir, and the or each tablet is stored within a sealed compartment located within a closure member for the reservoir. Usefully the tablet is separated from the liquid by a breakable seal carried by the closure member or by the reservoir. Preferably, the package is adapted so that the seal can be broken by the closure member, usefully by the user moving the closure member relative to the reservoir.

In a first embodiment, after the seal has been broken the or each tablet is able to enter the liquid. Such an embodiment is particularly suitable for a soluble tablet.

In a second embodiment there is a grill member located between the reservoir and the compartment which can allow passage of the liquid but prevent passage of the tablet; in this way, the tablet can be retained within the closure member when the seal is broken, and can be carried by the water into the user's mouth when the package is suitably oriented. Such an embodiment is particularly suitable for a substantially insoluble tablet.

The closure member is usefully in the form of a screw cap which has a threaded engagement with a part of the reservoir.

In a third embodiment, the reservoir and closure member are joined by a predetermined tear or breakage line, the closure member and reservoir being separable by tearing or cutting the package along the line.

The closure member in this embodiment usefully comprises two flexible sheet members, at least one of which is breakable, the tablet being located between the sheet members.

In a fourth embodiment the breakable sheet member is adjacent the reservoir; with soluble tablets in particular, when using such an embodiment the tablet can be pushed through the breakable sheet into the liquid, and subsequently the closure member can be fully or partially removed to allow the liquid and dissolved tablet to be consumed. In use with a substantially insoluble tablet, the closure member may first be removed from the reservoir and the tablet pushed through the breakable sheet to fall onto the user's hand or other suitable surface, from where it can be placed into the mouth to be carried into the stomach by the subsequent drinking of the liquid.

As above indicated, the tablet may be soluble in the liquid, in which case the package is adapted to allow the tablet(s) to be mixed with the liquid prior to consumption. Alternatively, the tablets may be substantially insoluble, in which case the package is adapted to allow the tablets to be consumed together with or immediately prior to the liquid.

The reservoir may be of flexible material, so that it can be compressed to force the liquid out of the reservoir.

Usefully, the maximum number of tablets in the package is three; preferably the maximum number is two.

Accordingly, the package can be sold so as to alleviate the immediate symptoms of a headache or other ailment without likelihood of the user taking an overdose, i.e. it is unlikely that a large number of the packages would be stored by a user for future use, so that the user is not likely to have ready access to the number of tablets necessary to result in a fatal or injurious overdose. In this respect, in the U.K. in particular, it has recently been announced that the maximum number of tablets of certain medicants which can be sold together is to be reduced, in the hope that this will reduce the incidence of fatal or injurious overdoses of certain drugs.

In certain embodiments of the invention, the tablet is stored within a sealed compartment within the closure member, the closure member having an aperture through which either the user may apply pressure to release the tablet from the compartment and into the reservoir, or else the user may dispense the tablet from the compartment.

Usefully also, the sealed compartment is located between two sheets, at least one of the sheets being breakable upon applied pressure to permit release of the tablet. Preferably, the sealed compartment is supplied by a specialist tablet manufacturer or supplier, and comprises a sheet of aluminium foil and a sheet of plastics material surrounding one or more tablets.

Desirably, at least one of the sheets also acts as a seal for the reservoir.

Preferably, one of the sheets is provided by a part of the closure member for the reservoir.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figures 1, 2, 3:
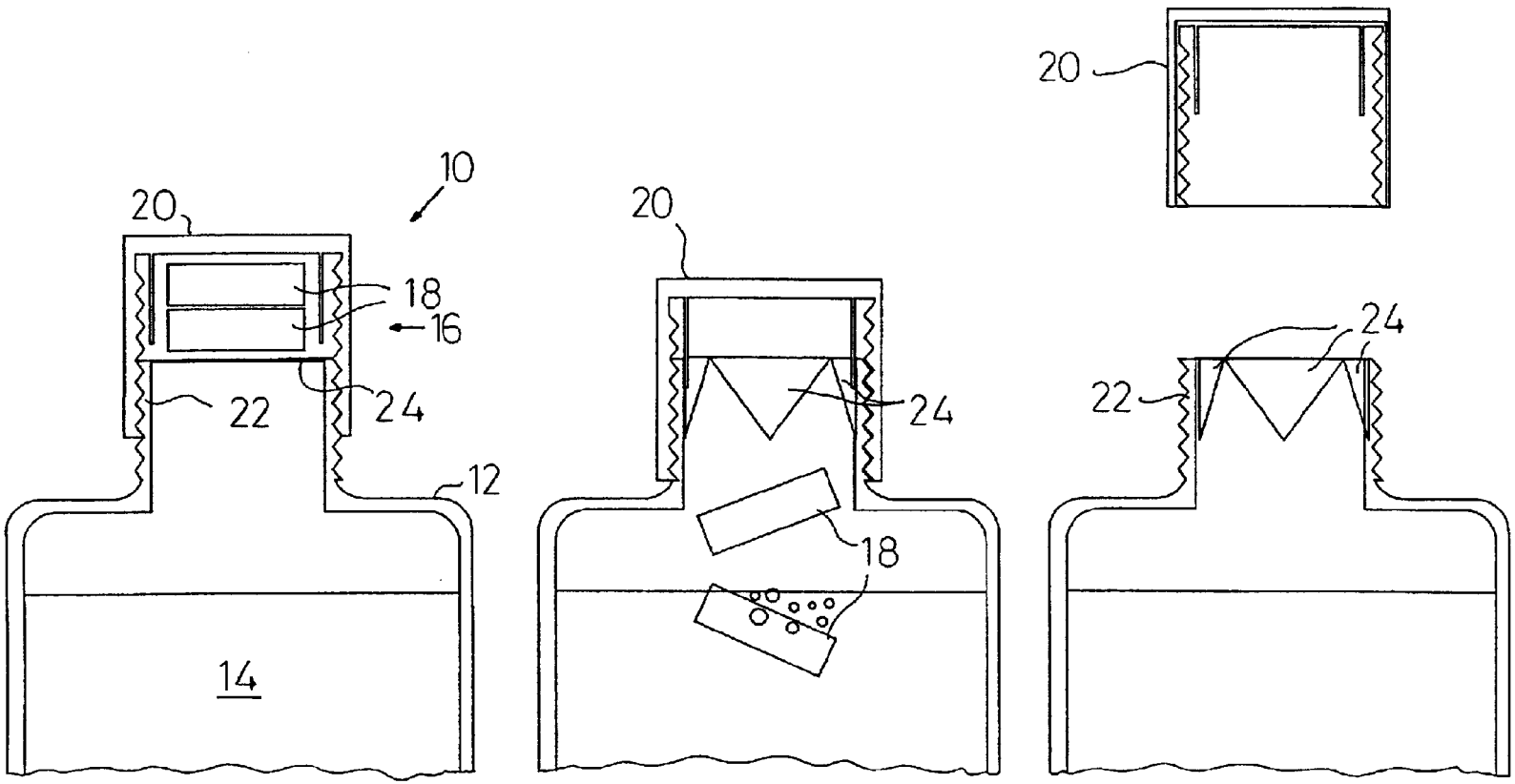
FIG. 1 shows part of a first embodiment of tablet package according to the invention, the closure member being shown in sectional view, the package being in the "as sold" condition.
FIGS. 2–3 are views as FIG. 1 with the package in use.

In the following description, similar parts of the various embodiments are generally given similar reference numerals.

The tablet package 10 comprises a reservoir 12 for liquid 14, and a compartment 16 for the tablets 18. In this embodiment the liquid 14 is water, and the tablets 18 are of medicant such as a pain relieving drug. Two tablets 18 are shown, though in other embodiments one or more tablets could be included, corresponding to a single prescribed dose for an adult or the intended user of the drug.

The tablet compartment 16 is located within the closure member 20 of the container 10, the closure member being in the form of a threaded cap having a screw connection with the neck 22 of the reservoir 12.

The tablets 18 are maintained separate from the water 14 by a partition 24, suitably of aluminium foil or the like, which partition 24 spans the opening of the neck 22 of the reservoir 12; i.e. in use the reservoir 12 is filled with a predetermined quantity of water and then the partition 24 is sealingly applied to the neck in known fashion so as to prevent subsequent leakage of the water.

When the cap 20 is fitted in its "as sold" condition of FIG. 1, the cap 20 is partially screwed onto the neck 22, so that the tablets 18 (or rather the lowermost tablet), rests upon the partition 24.

In an alternative embodiment, the partition is fitted to the cap, i.e. the tablets are inserted into the cap and the partition is sealingly inserted thereinto. However, the former embodiment is preferred since the partition 24 acts both to prevent leakage of the water 14 during transportation of the package 10, and also to prevent the water from coming into premature contact with the tablets 18.

When it is desired to use the package 10, the cap 20 is fully screwed down onto the neck 22 of the reservoir 12. This forces the tablets 18 through the partition 24, breaking the partition and permitting the tablets 18 to drop (in the orientation shown) past the broken partition and into the water 14 (FIG. 2).

In this embodiment the tablets 18 are soluble, and the reservoir may be shaken to ensure that the tablets have fallen from the cap 20 into the water.

The cap 20 may subsequently be removed fully from the neck 22 of the reservoir 12 (FIG. 3), permitting the water and dissolved tablets to be drunk. Removal of the cap 20 also permits the venting of any gas in the event that the tablets 18 are effervescent.

Preferably, the walls of the reservoir 12 are transparent to permit the user to observe when the tablets 18 have become fully dissolved.

Figure 6:
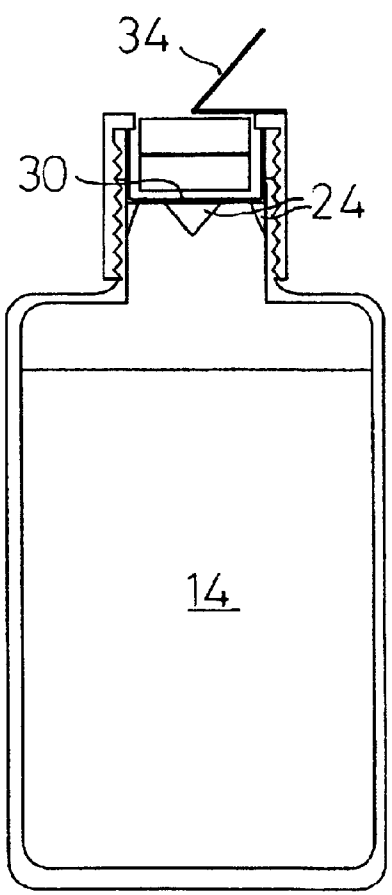
FIGS. 5–7 are views as in FIG. 4 with the package in use.
Figure 5:
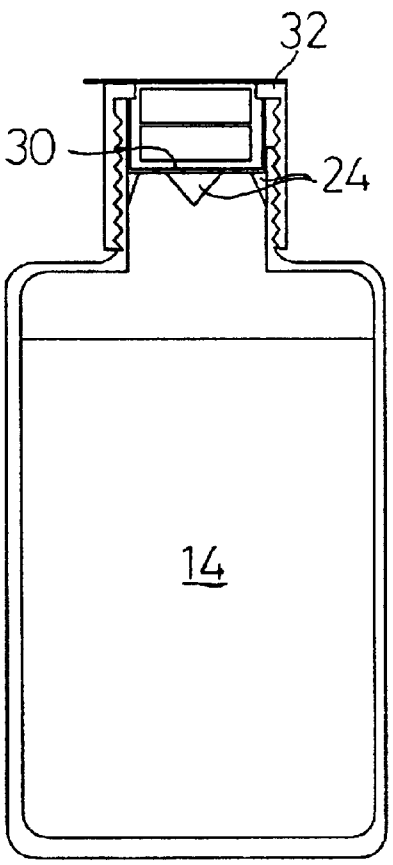
Figure 4:
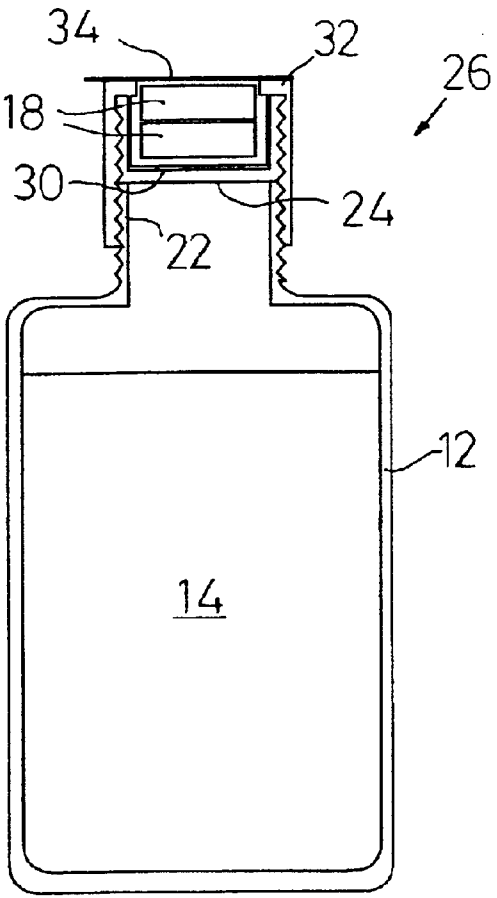
FIG. 4 shows a second embodiment of tablet package, the package being in the "as sold" condition.

The second embodiment shown in FIGS. 4–8 is intended for tablets which are substantially insoluble, or which are intended to be consumed as solid, and so do not require mixing with water prior to consumption. With such tablets, it is preferable to prevent the tablets 18 from falling into the reservoir 12, since in such circumstances they may remain in the reservoir when the reservoir is inverted to permit the water to be drunk. In this embodiment therefore, a grill member 30 is provided in the cap 32, which permits the passage of water (FIG. 7), and yet which can prevent the tablets 18 from entering the reservoir 12 (FIGS. 5,6).

The second embodiment also differs from the first embodiment of FIGS. 1–3 In that the cap 32 has a removable seal 34 to permit the contents to be consumed. Operation of the second embodiment is effected as follows.

The tablet package 26 has a partition 24 similar (or perhaps identical) to that of the first embodiment. In the condition as sold (FIG. 4), the partition spans the neck 22 of the reservoir 12, and separates the water 14 from the tablets 18. The cap 32 is partly screwed onto the neck 22 when sold.

Figure 7:
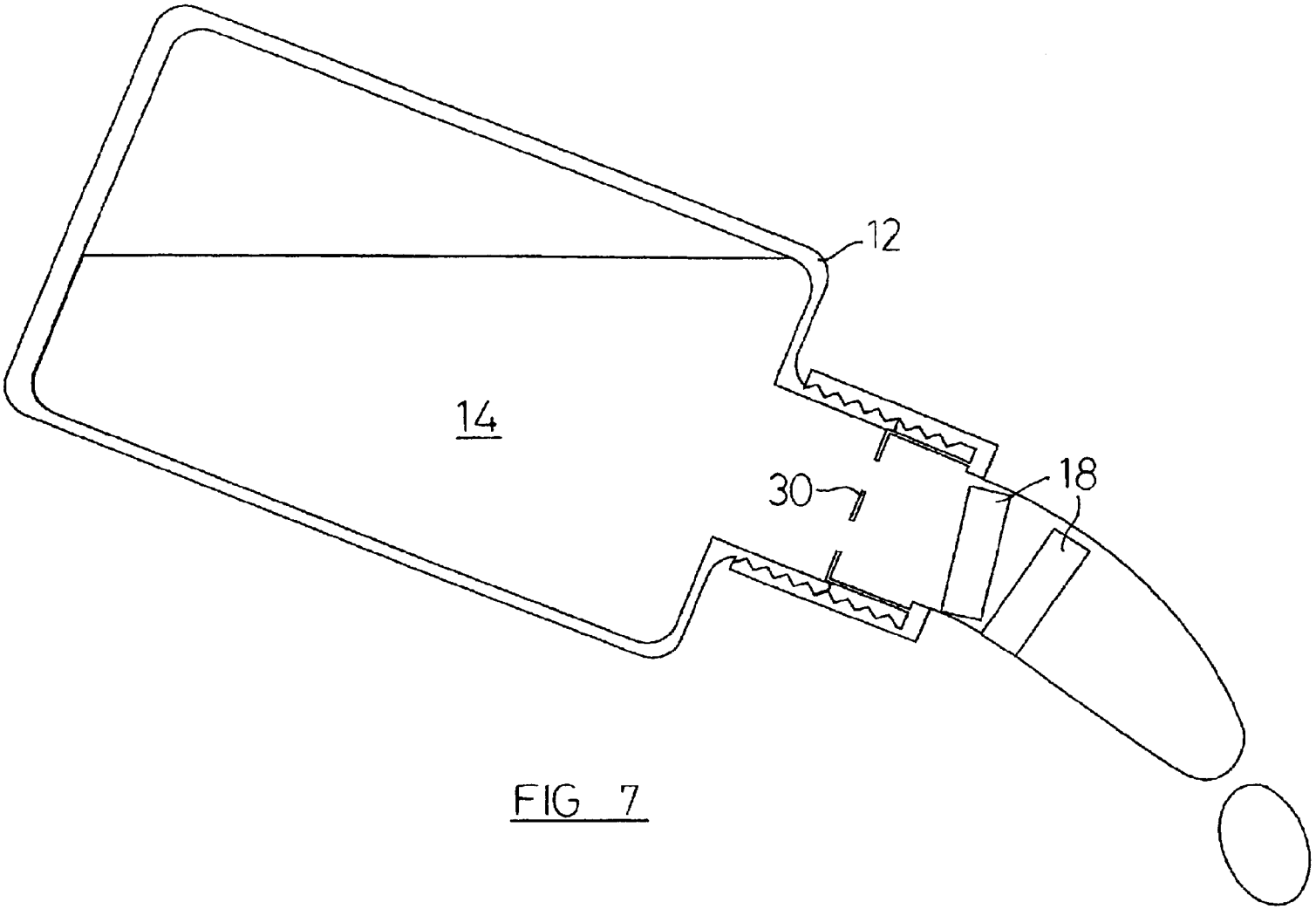
Figure 8:
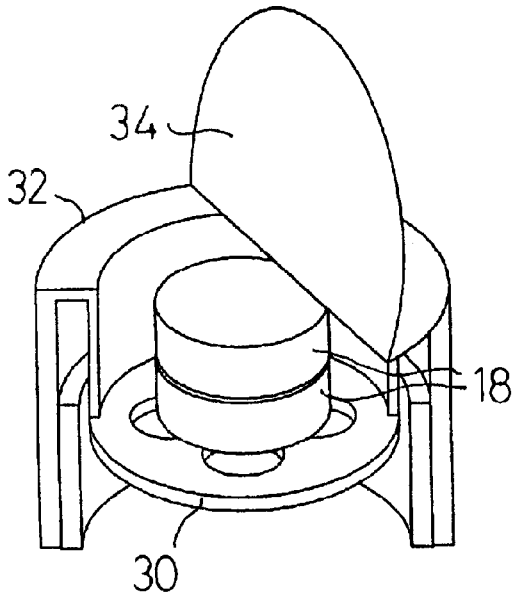
FIG. 8 is an enlarged view of part of the closure member of the second embodiment.
Figure 11:
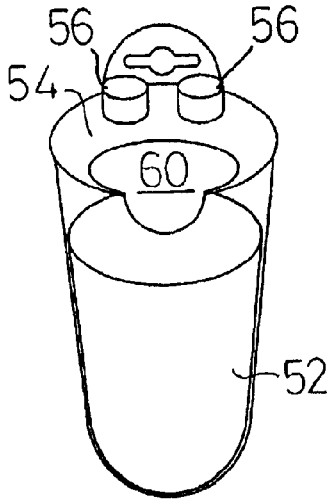
FIG. 11 is a perspective view of the fourth embodiment.

To break the partition 24, the cap 32 is screwed further onto the neck 22, forcing the grill member 30 through the partition 24 (FIG. 5). The seal 34 may then be peeled off the cap 32, to expose the tablets therebeneath (FIGS. 6,8). Inversion of the storage container 26 will cause the tablets 18 to fall out, or be washed out, of the cap 32 by the following water 14, allowing the tablets and water to be so consumed together (FIG. 7).

The first and second embodiments described above have the considerable advantage that no hand contact is required with the tablets 18 prior to their consumption, i.e. the tablets can be consumed or added to the water directly from the cap 20,32. Such embodiments are therefore likely to be particularly suitable in conditions when the hygiene of the user's hands is unacceptable.

However, the known medicant "blister packs" are in widespread use in which it is necessary to place the tablet into the user's hand, or onto a suitable surface, and then indirectly into his or her mouth. Since these packs are generally accepted, the third embodiment of the invention shares this feature with such packs.

In an alternative embodiment to the second embodiment of FIGS. 4–8 a circular sealing member such as a resilient plastics disc of known form can be carried by the screw-cap adjacent the sheet 70. The sealing member can be designed to prevent the leakage of water from the reservoir, and in use can replace the partition 24. In such an design, it is necessary to remove the cap to consume the liquid (after having first removed the removable seal 34 and the tablet(s) located within the cap.

Figure 9:
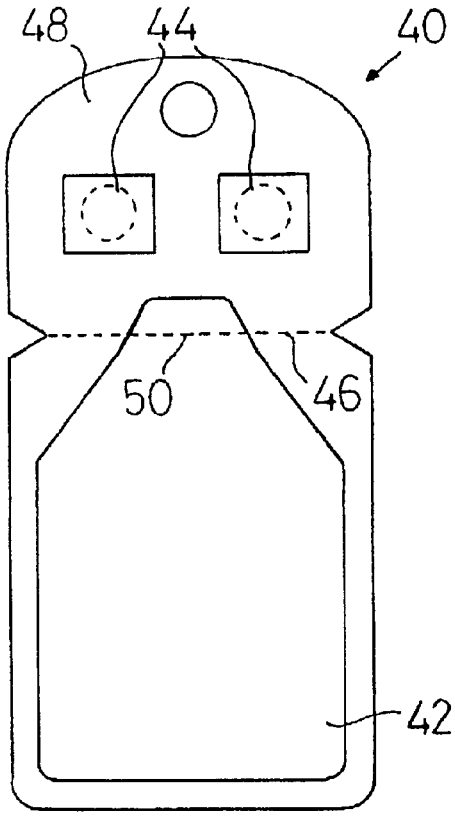
FIG. 9 is a front view of a third embodiment of tablet package "as sold"
Figure 10:
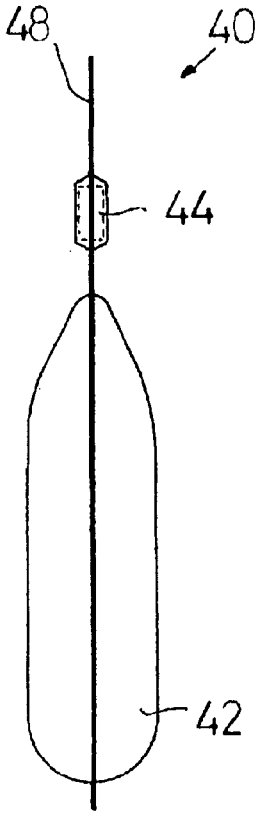
FIG. 10 is a side view of the third embodiment.

The third embodiment shown in FIGS. 9 and 10 is of a tablet package 40 comprising a reservoir 42 for liquid and (separate) compartments 44 for the tablets. The package 40 is made generally of a flexible plastics material, though the planar sections (see FIG. 10) may suitably be stiffened in known fashion to provide some rigidity to the package.

The tablets are located between two sheet members which together define the compartments 44; one of the sheet members is designed to be breakable (perhaps being of aluminium foil or other suitable material such as thin plastic), and the tablets may be removed from the compartments 44 in known fashion, i.e. by pushing them from one side until the tablets are forced through the breakable sheet.

It will be understood that reference in this specification to a "breakable" sheet in practice means a "more readily breakable sheet", since the sheets on both sides of the tablet will each be breakable with sufficient force. However, it will be understood that this wording is used to describe a feature certain embodiments have in common with known "blister packs", in that one sheet (the "unbreakable" sheet) is designed to receive finger or thumb pressure which presses the tablet against the other (breakable) sheet until the latter sheet breaks or tears and the tablet can be forced therethrough.

When the tablets are forced through the breakable sheet, they fall into the user's hand or other suitable surface, from where they may be placed into the user's mouth.

The package can then be torn along the perforated or otherwise weakened line 46, which line separates the reservoir 12 from the closure member 48, the line 46 crossing the "neck" 50 of the reservoir 42. In this way, the reservoir 12 can be opened, permitting the user to pour or squeeze out the water from the reservoir 12 so that this may be drunk so as to wash the tablets into the user's stomach.

In an alternative embodiment to that of FIG. 9, the reservoir has a removable cap, and the tablet or tablets can be released by tearing along a predefined line, the line intersecting a part of the compartment(s) locating the tablet (s). The package can include means to prevent the tear continuing into or through a part of the reservoir.

In the fourth embodiment of tablet package, suited to use with soluble tablets, the reservoir 52 is in the form of a cup, with a lid 54 sealingly applied thereto. The lid 54 comprises two sheets which define the compartments 56 for the tablets therebetween. To use such an embodiment, the user pushes the tablets through the breakable sheet (the lowermost sheet of the lid which is not shown in this figure) and into the liquid by manual pressure on the uppermost sheet, specifically manual pressure on the part(s) of the uppermost sheet which provides a part of the compartment(s) 56. Subsequently, a part 60 of the lid 54 may be removed and the liquid and dissolved tablets consumed. It will be understood that in this embodiment a part of the uppermost sheet of the lid 54 also provides a part of each compartment 56, i.e. the compartments are in part created by formations provided in the uppermost sheet of the lid 54.

In the fifth embodiment of FIGS. 12–15, the tablet package includes a cap 62 which has a screw connection with the neck of the liquid reservoir 12. As better seen in FIG. 13, the screw cap has an aperture 64 and locates a self-contained tablet pack 66.

The tablet pack 66 comprises a tablet 18 which is sealed between a flexible plastics sheet 68 and a breakable aluminum foil sheet 70. In alternative embodiments, alternative materials can be used for the sheets, and perhaps the same material may be used for both sheets, if desired.

Preferably, the sheet 70 can also act as a seal for the reservoir 12, i.e. when the screw cap 62 is firmly secured onto the reservoir 12, the sheet 70 seals the reservoir so that the liquid 14 contained therein does not leak out. Alternatively, the sheet 70 may carry a separate annular seal adjacent its periphery, or a separate annular seal may be fitted to the neck of the reservoir, in known fashion.

Figure 14:
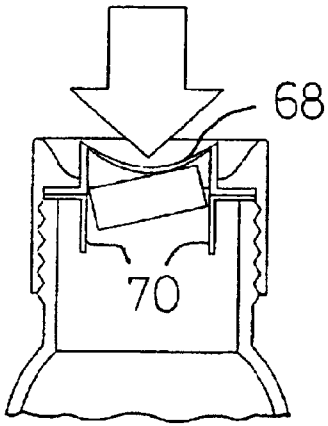
Figure 13:
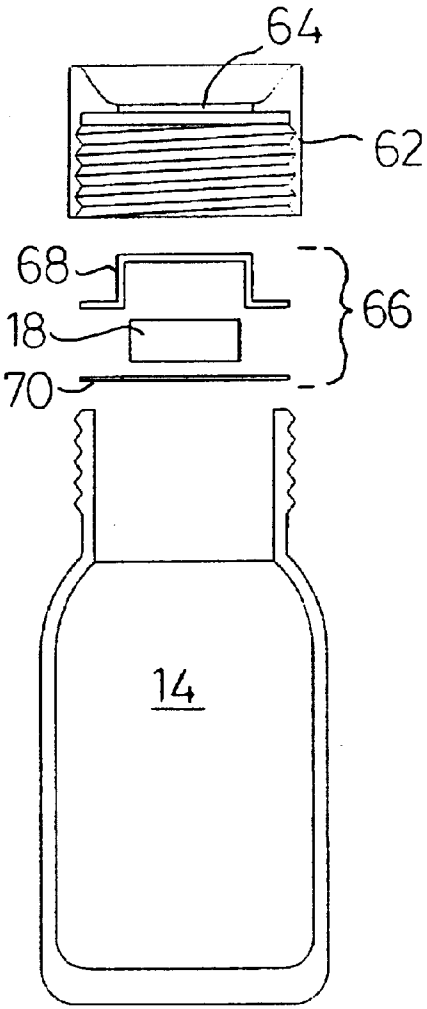
FIG. 13 is an exploded view of the components of the tablet package of FIG. 12.
Figure 12:
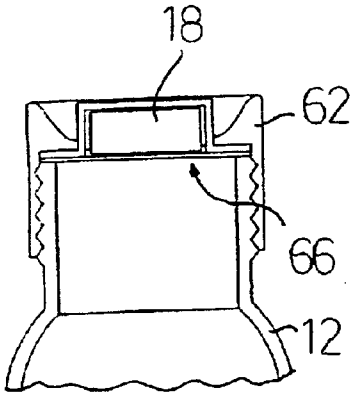
FIG. 12 shows a part of a fifth embodiment of tablet package according to the invention, in sectional view, and in the "as sold" condition.

The fifth embodiment is designed to be suitable for a soluble tablet or tablets. To use this embodiment, the user places a thumb or finger upon the sheet 68 exposed through the aperture 64, and applies pressure so as to break the sheet 70 and subsequently to push the tablet 18 through the sheet 70 and into the reservoir (FIG. 14). The cap 62 can subsequently be removed (FIG. 15) to permit the liquid and dissolved tablet to be drunk.

The sixth embodiment of FIGS. 16–19 is similar to that of FIGS. 12–15, but is adapted for use with a non-soluble tablet. It will be seen from FIG. 17 in particular that the components of this embodiment are the same as those of the fifth embodiment described above, but that the tablet pack 66 is inverted, so that the breakable sheet 70 is adjacent the aperture 64 in the cap 62, and the "unbreakable" sheet 68 is adjacent the reservoir 12.

Figures 16, 17, 18, 19:
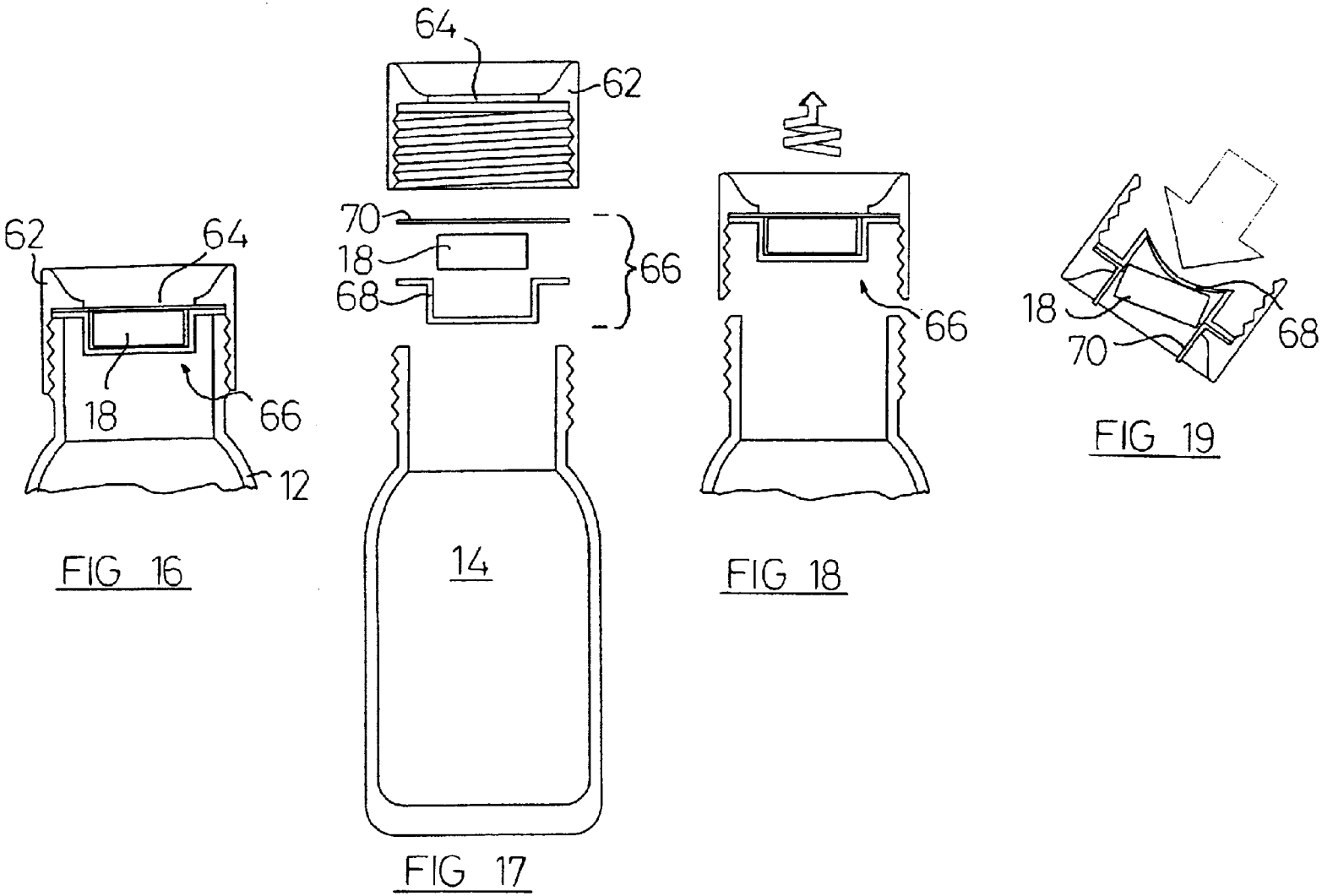
FIG. 16 shows a part of a sixth embodiment of tablet package according to the invention, in sectional view, and in the "as sold" condition.
FIG. 17 is an exploded view of the components of the tablet package of FIG. 16.
FIG. 18–19 are views as FIG. 16 with the package in use.

To use the sixth embodiment, the cap 62 is first removed intact (FIG. 18). The user then places a thumb or finger against the sheet 68 and applies pressure so as to break the sheet 70 and push the tablet 18 through the sheet 70 and also through the aperture 64. The cap may be positioned so that the tablet 18 falls directly into the user's mouth; alternatively, the tablet may fall onto the user's other hand, or another suitable surface or before being placed into the user's mouth. The user can subsequently drink the liquid from the reservoir 12 so that the tablet and liquid can be consumed together.

It will be understood that the tablet pack 66 should be sized to remain within the cap 62 when the cap is removed from the reservoir. This may for example be achieved by arranging that the pack 66 is a suitably tight fit within the cap 62, so that it is effectively retained by the threads thereof.

It will be understood that in the sixth embodiment it is the sheet 68 which must provide the seal for the reservoir, or else has a suitable seal affixed thereto.

The tablet pack 66 may be a conventional "blister pack". However, it is expected to be a major advantage of the sixth embodiment that the tablet 18 will be easier to remove from its pack than with similar prior art blister packs. Thus, the cap 62 within which the tablet pack 66 is located provides a substantially rigid structure which the user can grip to dispense the tablet. It is thus expected that the old, infirm and/or disabled will find the tablet far easier to dispense than with prior art blister packs in which both sheets are flexible and a suitable grip is more difficult to achieve.

Since the fifth and sixth embodiments employ the same components, and in particular employ the same tablet pack 66, it will only be necessary for the tablet package manufacturer to choose the orientation of the tablet pack 66 within the cap 62, depending upon whether the tablet is soluble or not.

In other embodiments, it may be arranged that the tablet pack comprises two breakable layers, one to each side of the tablet. In such embodiments the orientation of the tablet pack is not important and all tablet packages can be manufactured with the same pack orientation. However, this is not preferred since it is desirable for the user to be alerted to push the tablet in a specific direction, so as to reduce or avoid the likelihood that a non-soluble tablet is dispensed into the liquid, or that a soluble tablet is consumed whole. Whilst the instructions on the package would likely indicate the correct method of use, it would be an additional benefit if the user recognised that it was necessary to press the tablet through the aluminium layer, for example.

It is another advantage of the fifth and sixth embodiments that the manufacturer of the tablet package need not handle or otherwise contact the tablet 18. Thus, the tablet pack 66 could, and preferably would, be supplied by a specialist tablet manufacturer or supplier, for insertion into the cap 62. Thus, the tablet package manufacturer must not necessarily ensure that his facilities meet the stringent safety and cleanliness standards necessary for the manufacturers of drugs and the like.

Clearly, in other embodiments, two (or perhaps more) tablets could be located within the pack 66, suitably one on top of another so that they can both (or all) readily be dispensed from the cap.

In common with the other embodiments, it is expected that a protective cover would be applied to prevent inadvertent dispensing of the tablet 18 before the tablet package is sold or to be used, the cover preventing access to the aperture 64. Also, a tamper-evident seal and/or other means of ensuring that the cap 62 or cover is not removed other than by the eventual user, should ideally be utilised.

Figure 20:
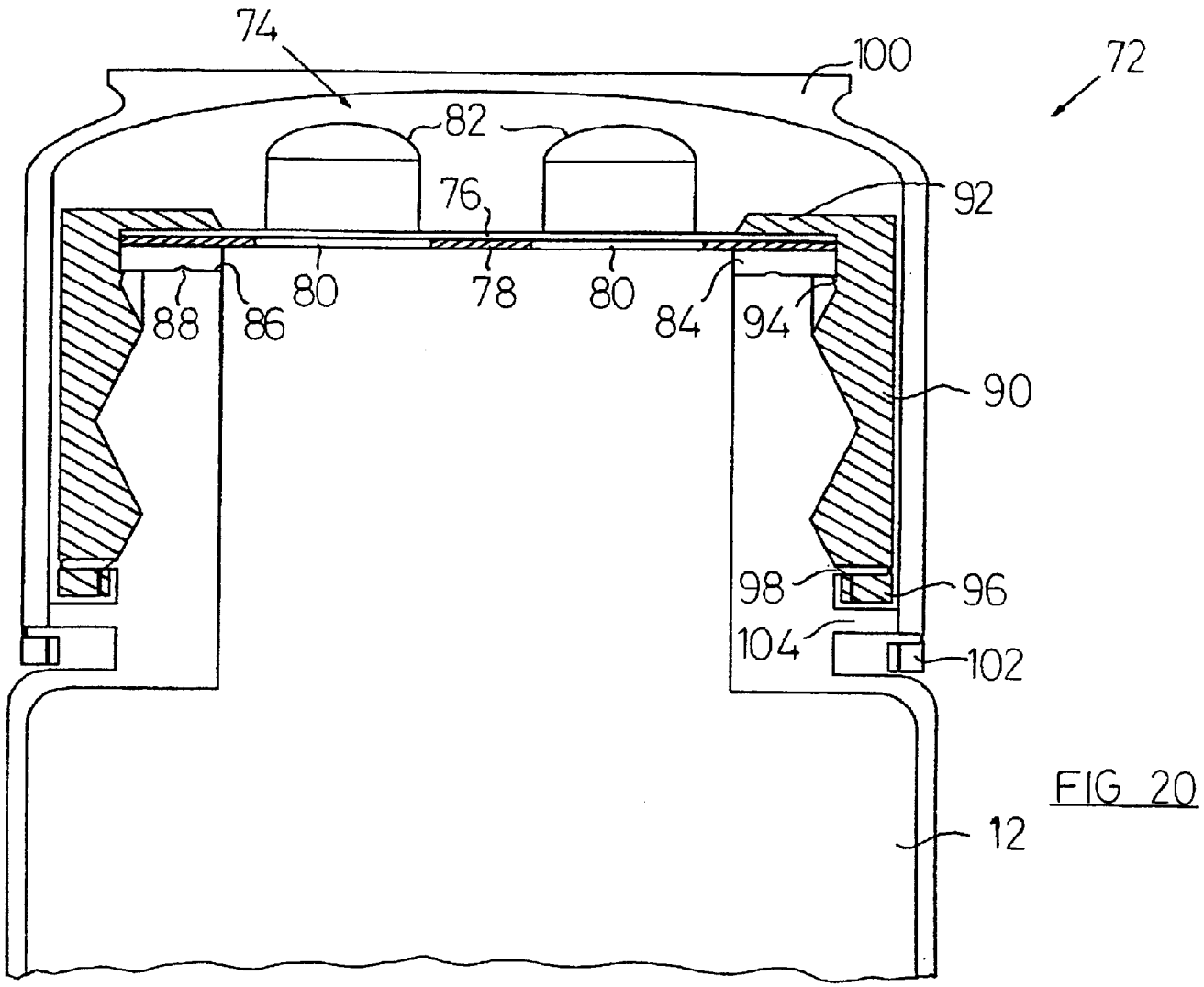
FIG. 20 shows a part of a seventh embodiment of tablet package according to the invention, in sectional view, and in the "as sold" condition.

The seventh embodiment of tablet package 72 shown in FIG. 20 is somewhat similar to the fifth embodiment shown in FIGS. 12–15. Thus, the tablets (not seen) are located in a tablet pack 74 between two sheet of material; the tablet pack 74 may also suitably be in the form of a conventional "blister pack", for example. In this embodiment there are two tablets, but in common with the other embodiments there may be one or more tablets, as desired.

The sheet 76 of the tablet pack 74 is breakable, and upon suitable pressure being applied to the "unbreakable" sheet 82 a tablet or tablets may be ejected through the layer 76.

Located immediately beneath (as drawn) the tablet pack 74 is a washer 78 (shown with diagonal section lines for clarity). The washer 78 has two openings 80 located beneath the tablets, and through which the ejected tablets can pass. The washer is substantially rigid, or at least is more rigid than the tablet pack 74, and sufficiently rigid to limit the bending of the tablet pack 74 under the application of pressure. Accordingly, the washer 78 ensures that the layer 76 is more likely to break than to bend, so facilitating reliable ejection of the tablets into the reservoir 12.

Beneath (in the orientation as drawn) the washer 78 is a sealing member 84, which is of suitable sealing material and in this embodiment is in the form of an annulus. The sealing member 84 acts to provide a seal between the washer 78 and the top 86 of the reservoir 12.

As shown, the top 86 of the reservoir 12 can have a raised rib 88 which acts to improve the seal between the reservoir 82 and the washer 78, and reduces the likelihood of liquid in the reservoir 12 leaking out.

The cap 90, which is also shown with diagonal section lines for clarity, has an annular lip 92 which overlies a part of the tablet pack 74 and (when the cap 90 is tightened upon the neck of the reservoir 82) compresses the periphery of the tablet pack 74 and so the washer 78 into sealing engagement with the sealing member 84. The cap 90 has an internal ledge 94 which secures the tablet pack 74, washer 78 and sealing member 84 within the cap, to facilitate ease of manufacture, and also to ensure that these components are removed with the cap 90 when the cap is ultimately removed by the customer.

Additional sealing members can be provided between the washer 78 and the tablet pack 74, and/or between the tablet pack 74 and the lip 92, if desired or required.

The cap 90 has a tamper-evident closure, comprising a breakable ring 96 which locates beneath a ledge 98 of the neck of the reservoir 12.

The cap 90 is covered in the as-sold condition by a protective cover 100, which has its own tamper-evident closure in the form of breakable ring 102 located beneath ledge 104 of the neck of the reservoir 82.

Figure 15:
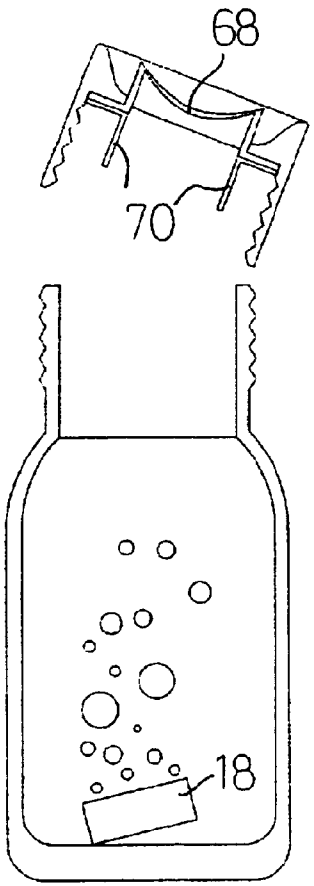
FIGS. 14–15 are views as FIG. 12 with the package in use.

Use of the seventh embodiment of tablet package is similar to that described in relation to the fifth embodiment, and specifically FIGS. 14 and 15.

Figure 21:
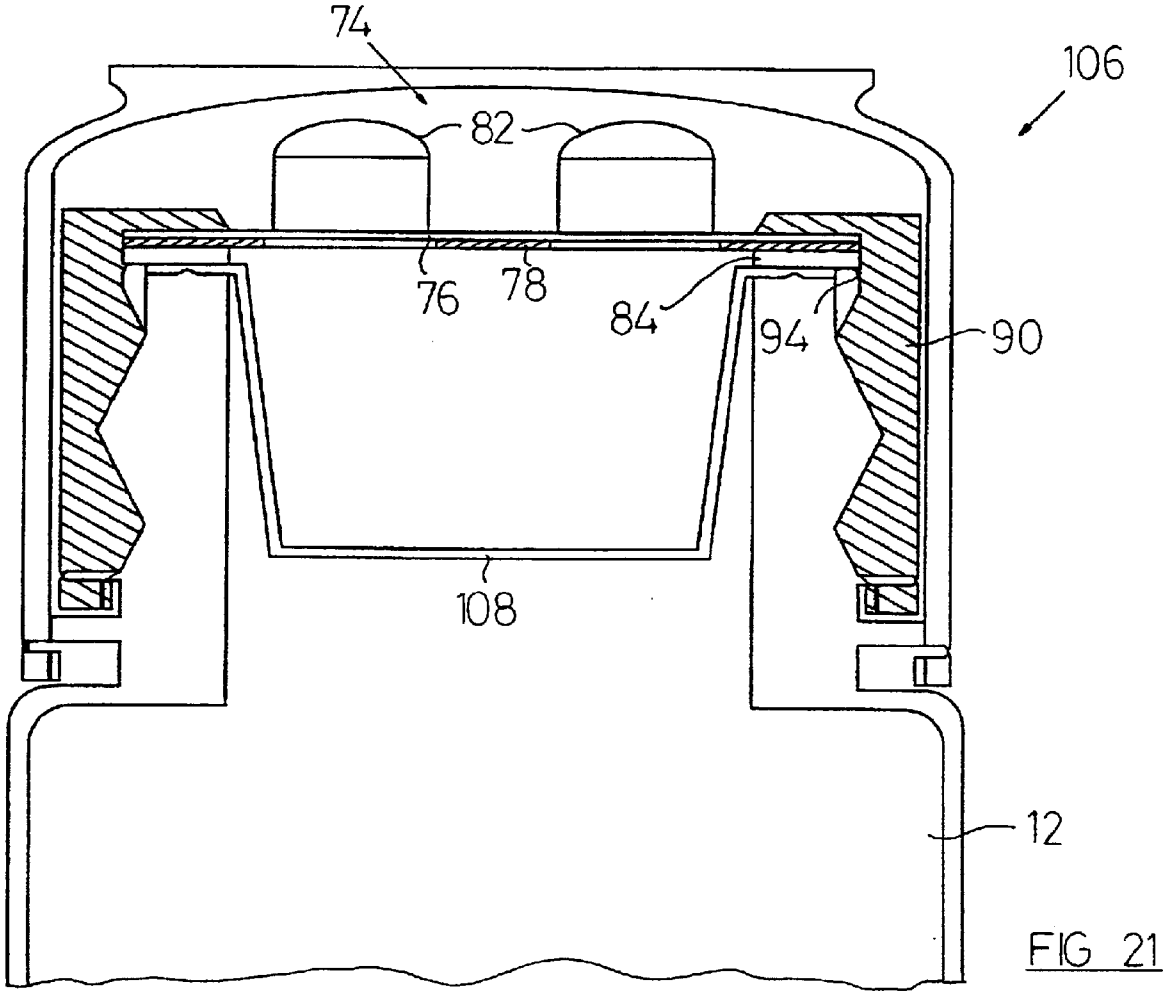
FIG. 21 shows a part of an eighth embodiment of tablet package according to the invention, in sectional view, and in the "as sold" condition.

The seventh embodiment of FIG. 20 is designed for use with soluble tablets. The eighth embodiment shown in FIG. 21 is somewhat similar to the sixth embodiment shown in FIGS. 16–19, and is designed for use with non-soluble tablets.

However, the eighth embodiment differs from the sixth embodiment in that the tablet pack 74 is oriented as in the seventh embodiment, rather than being inverted. Thus, the tablets are intended to be ejected from the tablet pack 74 of FIG. 21 downwardly, and a washer 78 is provided to assist with this. The tablet package 106 of FIG. 21 also has a sealing member 84.

To ensure that the non-soluble tablets of the tablet package 106 do not enter the liquid in the reservoir 12, a catching member 108 is provided, which separates the ejected tablets from the liquid in the reservoir 12.

The catching member 108 can be perforated as is the grill member 30 of the embodiment of FIGS. 4–7, to allow the liquid in the reservoir 12 subsequently to pass therethrough. However, in this embodiment the catching member 108 is imperforate. Thus, to enable the liquid from the reservoir to be consumed, the catching member 108 is removable. It is to be noted that the catching member is not secured to the cap 90 by way of the lip 94, but rather remains in contact with the reservoir after the cap 90 has been removed (the tablets having previously been ejected into the catching member). The catching member 108 is subsequently and separately removable from the reservoir, and can be used to introduce the tablets directly into a user's mouth, or to tip the tablets onto the user's hand for subsequent introduction into the mouth. Following the introduction of the tablets into the user's mouth, the user drinks the liquid in the reservoir 12 to wash down the tablets.

The advantage of an imperforate catching member 108 is that the user can allow the tablet or tablets to lie within the catching member without fear of the tablets starting to corrode and perhaps break down, as may occur in the presence of droplets or vapour of the liquid from the reservoir 12. Despite the fact that the tablets of this embodiment are of insoluble form, they may nevertheless corrode to some extent.

The catching member 108 is preferably of foil, and ideally includes a projecting or folded tab (not shown), which may be used to lift the catching member from the neck of the reservoir.

Apart from the catching member 108, the eighth embodiment of FIG. 21 is identical to the seventh embodiment of FIG. 20.

In the embodiments of FIGS. 20 and 21, the sealing member 84 is in the form of an annulus. In other embodiments the sealing member can be of similar form to the washer 78, i.e. continue across the top of the bottle. Such a sealing member would provide additional support to the washer 78, and further reduce the likelihood of the sheet 76 bending instead of breaking. In yet further embodiments, it might be possible to dispense with the washer provided that the sealing member was sufficiently rigid to provide the necessary support to the tablet pack 74, or the tablet pack was sufficiently rigid so that the sheet 76 would reliably break.

In the seventh and eighth embodiments shown, the tablet pack contains two tablets. It would of course be possible for the user only to use one of the tablets if the dosage of that tablet was sufficient. With non-soluble tablets, the user could decide only to consume only around half of the liquid in the reservoir, so that in effect the tablet package provides two doses, each one comprising one tablet and around half of the liquid. However, this is not preferred, since it is intended that the tablet package provide sufficent liquid for one dose only, whether that comprises one, two, or perhaps more tablets. Nevertheless, if it is foreseen that a user may seek to obtain two doses from one tablet package, then two catching members would preferably be provided, each taking up approximately half of the region of the neck of the reservoir, and each being located beneath one of the two tablets. In such embodiments, one tablet could be ejected into one of the catching members, and that catching member removed for introduction of the tablet into the user's mouth. Around half the liquid in the reservoir could then be consumed whilst the remaining catching member remains in place in the neck of the reservoir, to catch the remaining tablet when that is to be used.

Figure 23:
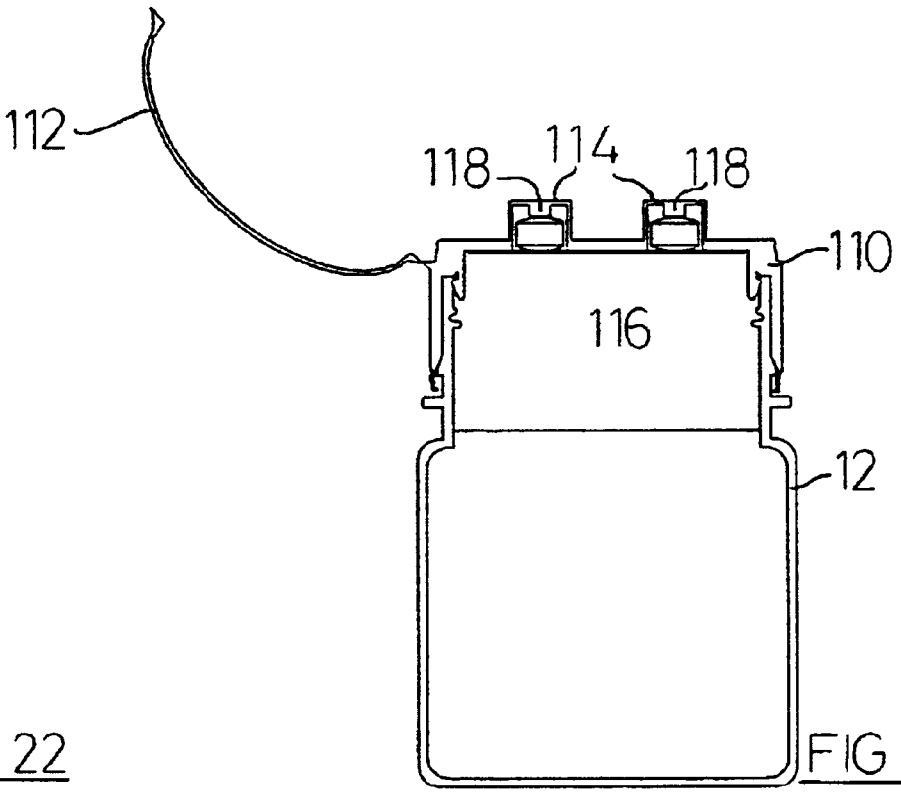
FIG. 23 shows a view as FIG. 22, but with the top open.
Figure 22:
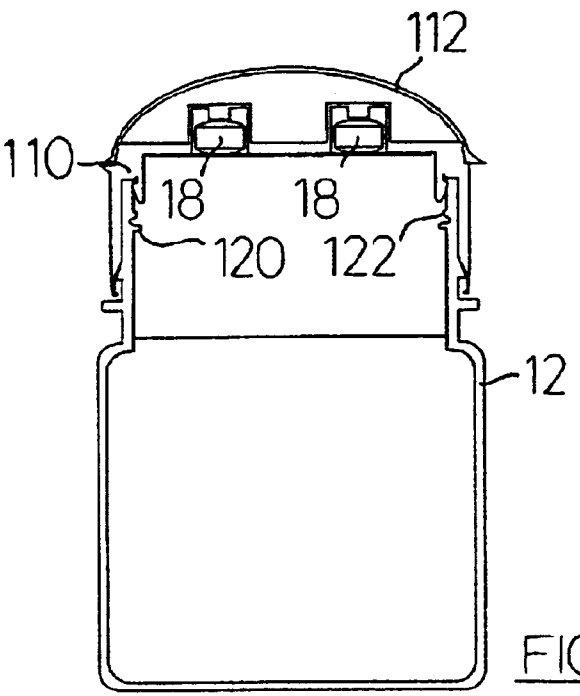
FIG. 22 shows a ninth embodiment of tablet package according to the invention, in sectional view, with the top closed.

In the ninth embodiment of FIGS. 22 and 23, the cap 110 of the tablet package carries a flip-top 112. Opening of the flip-top 112 requires sufficient dexterity and force so as effectively to provide a child-resistant cover, in known fashion. The cap 110 has integrally-moulded formations 114 which are flexible and provide the "unbreakable" sheet for the tablet package. The formations are of a size each to accommodate a tablet 18.

Suitably, the cap 110 is made from a plastics material, and the flip-top is integrally formed therewith, the hinge between the cap 110 and the flip-top 112 being a reduced-thickness length of plastic. Also, the formations 114 may comprise reduced-thickness portions of plastic, the reduction in thickness providing the required flexibility thereto.

The cap 110 also carries a breakable sheet 116, in this embodiment of aluminium foil, which prior to use secures the tablets 18 within the formations 114.

It will be seen that the formations 114 each include an internal nipple 118, which is intended to help ensure that the tablets 18 are reliably ejected from the cap 110 when the formations 114 are depressed.

The tablet package of FIGS. 22 and 23 is designed for soluble tablets, and can be used in a similar fashion to the earlier embodiments for such tablets. However, so as to make the components as standard as possible the reservoir 12 has an annular internal shoulder 120 which is intended to support the periphery of a catching member (perhaps of similar form to the catching member 108 of FIG. 21), which catching member will be fitted to the reservoir when the tablets 18 are insoluble. Located immediately adjacent the shoulder 120 is an annular lip 122 which is sized to be slightly smaller than the periphery of the catching member, allowing the catching member to be located into and removed from the reservoir 12, but preventing its inadvertent removal therefrom.

The cap 110 also includes a tamper-evident bead 124, of known form.

It will be apparent that many alternative designs, in addition to those shown and described, would be possible without departing from the scope of the invention.

Whilst as above indicated it is expected that the invention is likely to find its greatest utility with medicants such as pain relieving tablets, it is nevertheless expected to be suitable for glucose or other energy-giving tablets for sportsmen and women, for example those undertaking marathon races. Also, for use with vitamin or other health-enhancing tablets. Many of the described embodiments are likely to find particular use in situations where it is advantageous not to require hand-contact with the tablet prior to consumption, such as certain homeopathic remedies where hand contact can contaminate the remedy, or third world countries where hygiene cannot be guaranteed. Also, the invention will be particularly useful in locations where a supply of clean water cannot be guaranteed. In addition, users whose hands are dirty or unhygienic because of their occupation, for example a car mechanic, will not need either to clean their hands before taking a medicant, or to run the risk of acquiring an illness by contaminating the tablets prior to consumption.

What is claimed is:

1. A tablet package containing a predetermined number of tablet(s) and a predetermined quantity of liquid, the liquid being stored within a reservoir, the tablet(s) being separated from the liquid and stored within a sealed compartment carried by a closure member for the reservoir, at least part of the sealed compartment comprising a breakable sheet through which the tablet(s) can be ejected, wherein the container has separating means located between the breakable sheet and the reservoir to prevent the tablet(s) from entering the liquid.

2. A tablet package according to claim 1, wherein the sealed compartment also comprises a flexible sheet member, the tablet(s) being located between the flexible sheet member and the breakable sheet.

3. A tablet package according to claim 1, wherein each tablet is a medicant, and the predetermined number of tablet(s) can provide a single dose of the medicant.

4. A tablet package according to claim 1, wherein the liquid is water.

5. A tablet package according to claim 1, wherein the separating means is removable.

6. A tablet package according to claim 1, wherein there are two tablets and two separating means.

7. A tablet package according to claim 1, wherein the separating means is perforated.

* * * * *

UNITED STATES PATENT AND TRADEMARK OFFICE

CERTIFICATE OF CORRECTION

PATENT NO. : 6,386,358 B1
DATED : May 14, 2002
INVENTOR(S) : North et al.

It is certified that error appears in the above-identified patent and that said Letters Patent is hereby corrected as shown below:

Title page,
Item [57], ABSTRACT,
Line 4, "seperated" should be -- separated --

Column 1,
Line 66, "to tablets" should be -- tablets --

Column 5,
Line 4, "In" should be -- in --

Signed and Sealed this

Eighteenth Day of March, 2003

JAMES E. ROGAN
*Director of the United States Patent and Trademark Office*